US011475818B2

(12) United States Patent
Gao et al.

(10) Patent No.: US 11,475,818 B2
(45) Date of Patent: Oct. 18, 2022

(54) DISPLAY PANEL HAVING SUBPIXELS CONNECTED TO DIFFERENT SCANNING LINES AND DRIVING METHOD THEREOF

(71) Applicants: WUHAN TIANMA MICROELECTRONICS CO., LTD., Wuhan (CN); WUHAN TIANMA MICROELECTRONICS CO., LTD. SHANGHAI BRANCH, Shanghai (CN)

(72) Inventors: Yana Gao, Shanghai (CN); Xingyao Zhou, Shanghai (CN); Mengmeng Zhang, Shanghai (CN); Zhi Liu, Shanghai (CN); Kang Yang, Shanghai (CN)

(73) Assignees: WUHAN TIANMA MICROELECTRONICS CO., LTD, Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/236,403

(22) Filed: Apr. 21, 2021

(65) Prior Publication Data

US 2021/0241672 A1 Aug. 5, 2021

(30) Foreign Application Priority Data

Dec. 29, 2020 (CN) ..... 202011595193.1

(51) Int. Cl.
*G09G 3/20* (2006.01)
*G09G 3/32* (2016.01)

(52) U.S. Cl.
CPC ..... *G09G 3/2003* (2013.01); *G09G 3/32* (2013.01); *G09G 2300/0443* (2013.01);
(Continued)

(58) Field of Classification Search
CPC ..... G09G 3/2003
(Continued)

(56) References Cited

U.S. PATENT DOCUMENTS

2014/0152639 A1* 6/2014 Bang ..... G09G 3/3233 345/212
2014/0240379 A1* 8/2014 Jeong ..... G09G 3/2003 345/691
2017/0270867 A1* 9/2017 Zhu ..... G09G 3/3233

FOREIGN PATENT DOCUMENTS

CN 103680393 A 3/2014
CN 110619840 A 12/2019
CN 210575036 U 5/2020

* cited by examiner

*Primary Examiner* — Long D Pham
(74) *Attorney, Agent, or Firm* — von Briesen & Roper, s.c.

(57) ABSTRACT

Provided are a display panel, a display device and a driving method of the display panel. In the same row of pixel units, first control terminals of data write modules of sub-pixels having a first color are connected to the same first scanning line; and in the same row of pixel units, first control terminals of data write modules of sub-pixels having other colors except the first color are connected to the same second scanning line. The data write module is configured to provide a data signal cached by a data line for the drive transistor. In the same row of the pixel units, within time of one frame of a picture, time of providing data signals for data lines connected to sub-pixels having the first color is within time of writing data signals cached by data lines into pixel circuits of sub-pixels having the other colors.

15 Claims, 10 Drawing Sheets

(52) U.S. Cl.
CPC ..... *G09G 2300/0809* (2013.01); *G09G 2310/0297* (2013.01); *G09G 2310/08* (2013.01)

(58) Field of Classification Search
USPC ..... 345/691
See application file for complete search history.

DISPLAY PANEL HAVING SUBPIXELS CONNECTED TO DIFFERENT SCANNING LINES AND DRIVING METHOD THEREOF

CROSS-REFERENCE TO RELATED APPLICATIONS

This application claims priority to Chinese patent application No. 202011595193.1 filed with CNIPA on Dec. 29, 2020, the disclosure of which is incorporated herein by reference in its entirety.

TECHNICAL FIELD

The present disclosure relates to the field of display panels and, in particular, a display panel, a display device, and a driving method of a display panel.

BACKGROUND

An electroluminescent display is a kind of self-luminescent device, which can achieve a display function without setting a backlight module, so this kind of display has been widely applied in various fields because of its characteristics such as being light in weight, and thin in shape.

Under the background of narrow step demand for wearable products, a multiplexer is usually provided in the product, and the multiplexer needs to select mux 1:12 or more to reduce the number of signal traces in a total fan-out region of the display panel. At this time, the increase in the number of outputs in the multiplexer reduces the time of scanning a gate signal, resulting in the display panel being prone to having vertical stripes when displaying the picture, thus reducing the display effect. Based on this, how to improve the display effect of the high-frequency electroluminescent display needs to be solved urgently.

SUMMARY

Embodiments of the present disclosure provide a display panel, a display device, and a driving method of the display panel to improve the display effect of the high-frequency electroluminescent display.

In an embodiment, the present disclosure provides a display panel including a display region and a non-display region, the display region includes pixel units arranged in an array, and each of the pixel units includes sub-pixels having multiple colors.

Each of the sub-pixels includes a pixel circuit and a light-emitting element, and the pixel circuit in each of the sub-pixels includes a data write module, a light emission control module and a drive transistor. The non-display region includes a multiplexer, the multiplexer includes multiple data selection units; each of the multiple data selection units includes one input terminal and multiple output terminals, and the multiple output terminals of each data selection unit are electrically connected to multiple data lines of the display region in one-to-one correspondence.

In the same row of pixel units, first control terminals of data write modules of sub-pixels having a first color are connected to the same first scanning line; and in the same row of pixel units, first control terminals of data write modules of sub-pixels having other colors except the first color are connected to the same second scanning line.

The data write module is configured to provide a data signal cached by a data line to the drive transistor; and the light emission control module is connected in series respectively with the drive transistor and the light-emitting element, and the light emission control module is configured to control whether a drive current flows through the light-emitting element.

In the same row of the pixel units, within time of one frame of a picture, time of providing data signals for data lines connected to the sub-pixels having the first color is within time of writing data signals cached by data lines into pixel circuits of the sub-pixels having the other colors.

In an embodiment, the present disclosure further provides a display device including the display panel described in the above-mentioned embodiment.

In a third aspect, an embodiment of the present disclosure further provides a driving method of a display panel. The driving method is applied to the display panel described in the above-mentioned embodiment. A drive cycle of the display panel includes a data cache stage, a data write stage and a light emission stage. The driving method includes steps described below.

In the data cache stage, the multiplexer transmits the data signals to the multiple data lines to perform caching.

In the data write stage, data write modules provide the data signals cached by the multiple data lines for drive transistors.

In the light emission stage, the light emission control module controls the drive current to flow through the light-emitting element.

In the same row of pixel units, within the time of one frame of the picture, the time of providing the data signals for the data lines connected to the sub-pixels having the first color is within the time of writing the data signals cached by the data lines into pixel circuits of the sub-pixels having the other colors.

In the display panel, the display device and the driving method of the display panel provided in the embodiments of the present disclosure, according to the influences of sub-pixels having different colors on the display screen of the display panel, sub-pixels having a smaller influence on the display screen of the display panel are selected as the sub-pixels having the first color, and sub-pixels having a greater influence on the display screen of the display panel are selected as the sub-pixels having the other colors within the time of one frame of the picture. The time of providing the data signals for the data lines connected to the sub-pixels having the first color which have the smaller influence on the display screen of the display panel is set to be within the time of writing the data signals cached by the data lines into the pixel circuits of the sub-pixels having the other colors, that is, the display panel first provides the data signals for the data lines connected to the sub-pixels having the other colors; after the data signals are provided for the data lines connected to the sub-pixels having the other colors, the data signals are provided for the data lines connected to the sub-pixels having the first color. Since the sub-pixels having the other colors have completed providing the data signals for the corresponding connected data lines, providing the data signals for the data lines connected to the sub-pixels having the first color is simultaneous with outputting control signals to first control terminals of the data write modules corresponding to the sub-pixels having the other colors through the second scanning lines, so as to control the data write modules corresponding to the sub-pixels having the other colors to be turned on, it can be achieved that the data write modules in the pixel circuits corresponding to the sub-pixels having the other colors provide the data signals cached by the data lines for the drive transistors. Since the time of writing the data signals cached by the data lines of the sub-pixels having the other colors into the drive transistors is increased, ensuring the data writing time corresponding to the sub-pixels having the other colors which have the greater influence on the display effect of the display panel, increasing the charging time of the driving transistors in the pixel circuits corresponding to the sub-pixels having the other colors, and ensuring the display effect of the display panel.

DETAILED DESCRIPTION

Figure 1:
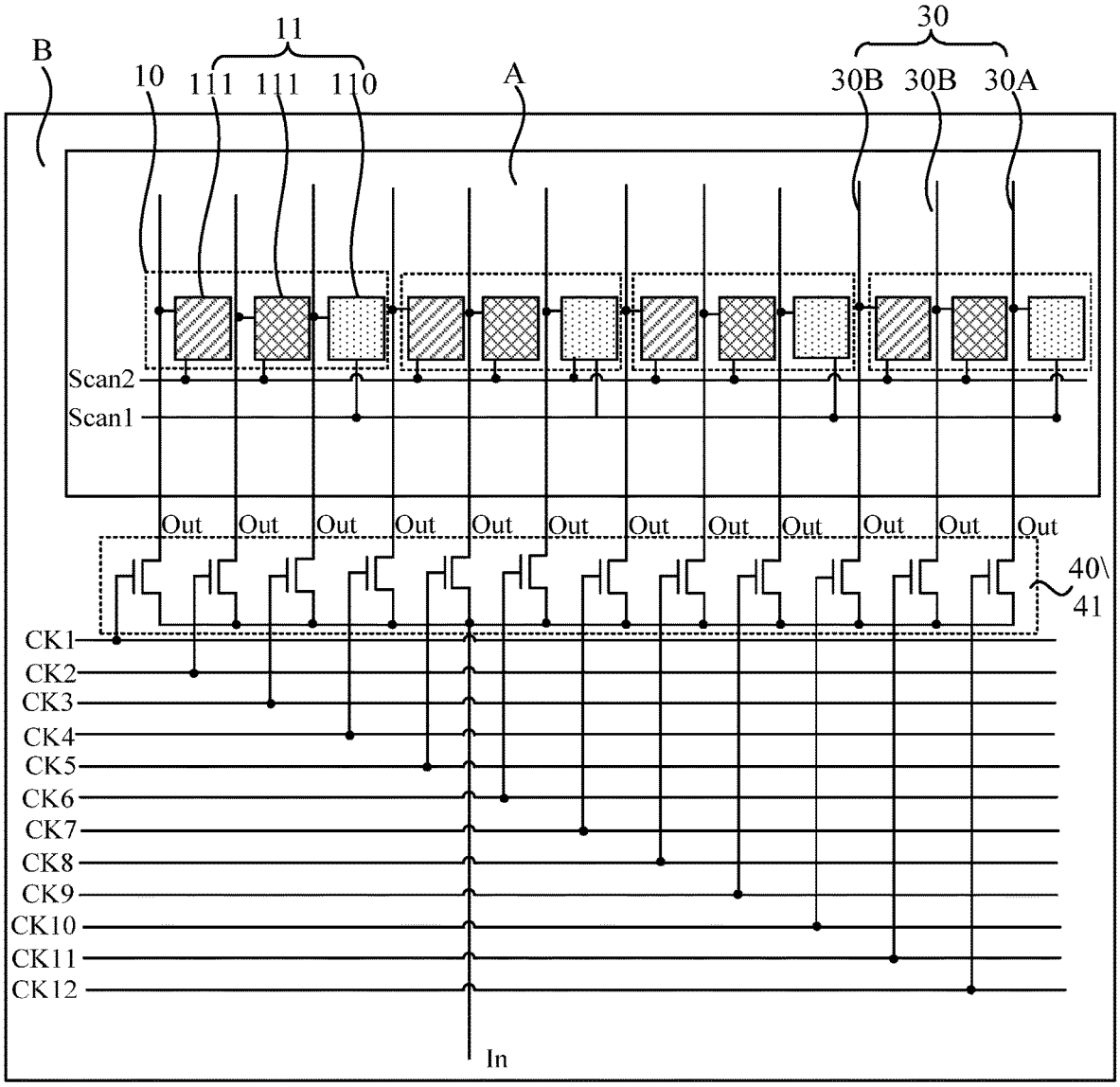
FIG. 1 is a structure diagram of a display panel according to an embodiment of the present disclosure.

Hereinafter the present disclosure will be further described in detail in conjunction with drawings and embodiments. It is to be understood that the embodiments set forth herein are intended to explain the present disclosure and not to limit the present disclosure. Additionally, it is to be noted that for ease of description, merely part, not all, of the structures related to the present disclosure are illustrated in the drawings.

The inventor finds in research that for a display without a multiplexer (for example, a demux) such as a display using a high-frequency (hipin) design, time corresponding to a conventional product (such as a product having a scanning frequency of 60 Hz) for displaying one frame is generally 16.67 ms. If this kind of product has the resolution of 1080*2340, the time of scanning 2340 rows of pixels is 16.67 ms, that is, the time of scanning one row of pixels is 7.1 μs. However, in a practical scanning process, factors such as time intervals between gate scanning signals input by adjacent gate lines need to be considered, therefore, the time of scanning one row of pixels is generally less than 5 μs in practice.

Similarly, for high-frequency products using the high-frequency design (such as products having a scanning frequency of 120 Hz), due to the increase of the scanning frequency, if time corresponding to displaying one frame of a picture remains unchanged, the time of scanning one row of pixels is reduced by at least half compared with that of low-frequency products, so the charging time of the gate scanning signal of high-frequency products is insufficient, which results in the display panel being prone to having vertical stripes when displaying the picture, thus reducing the display effect.

For high-frequency products providing with the multiplexer (such as the demux), if the gate scanning signal is input to a gate line, it is necessary that inputting the gate scanning signal to the gate line starts after the control line corresponding to a pixel row corresponding to the gate line finishes outputting the control signal. So that the charging time of the gate scanning signal is reduced to less than 0.5 μs within time of scanning one row of pixels, resulting in a serious shortage of the charging time of the gate scanning signal.

For displays (such as 4K or 8K displays) having large-size and high-resolution, with the further increase of the number of scanning rows, the time of scanning one row is further reduced, and accordingly, the charging time of the gate scanning signal becomes even less within the time of scanning one row of pixels, resulting in a serious influence on the display effect.

Figure 2:
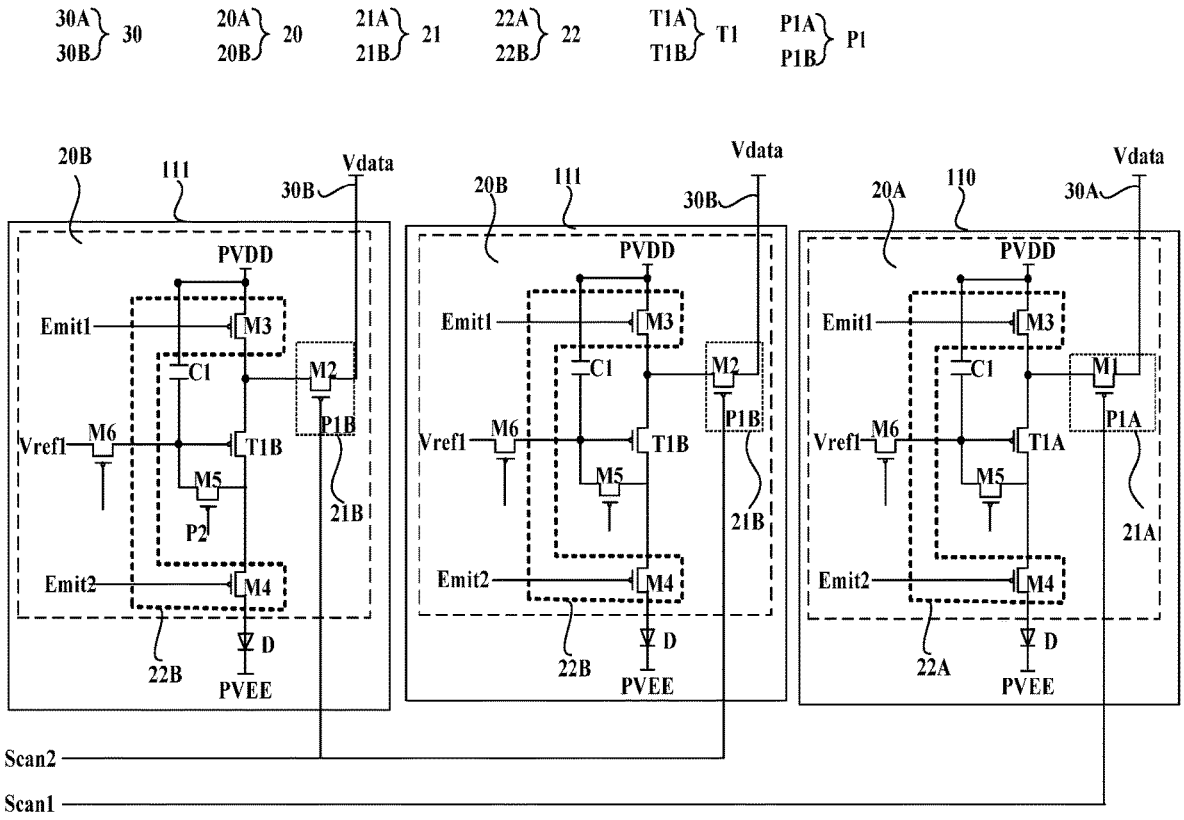
FIG. 2 is a structure diagram of sub-pixels in one pixel unit in a display panel shown in FIG. 1.
Figure 3:
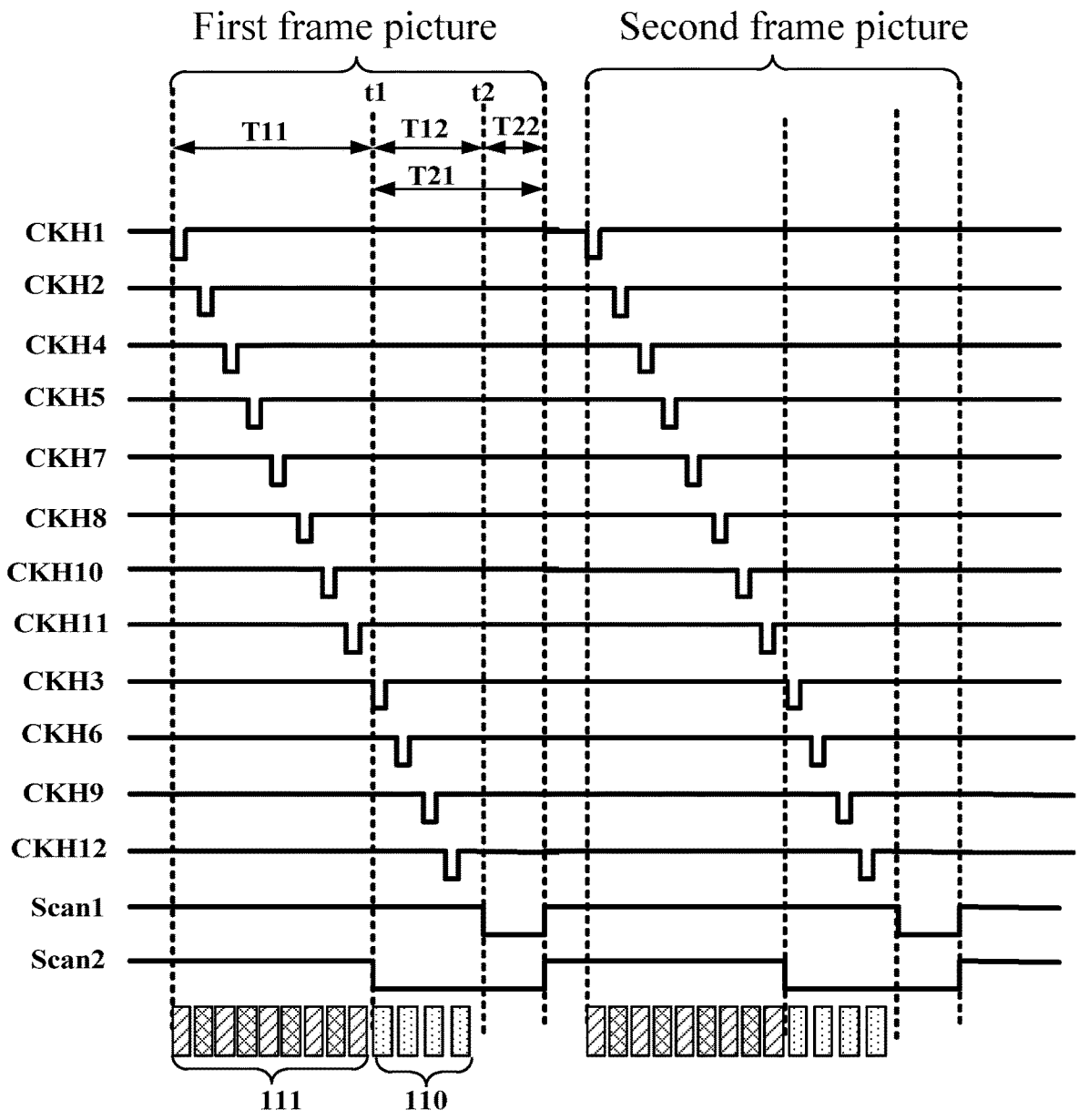
FIG. 3 is a driving timing diagram of the display panel shown in FIG. 1.

FIG. 1 is a structure diagram of a display panel according to an embodiment of the present disclosure, FIG. 2 is a structure diagram of sub-pixels in one pixel unit in a display panel shown in FIG. 1, and FIG. 3 is a driving timing diagram of the display panel shown in FIG. 1. As shown in FIGS. 1 to 3, a display panel includes a display region A and a non-display region B. The display region A includes pixel units 10 arranged in an array, and each pixel unit includes sub-pixels 11 having multiple colors. Each sub-pixel 11 includes a pixel circuit 20 and a light-emitting element D, and the pixel circuit 20 in each sub-pixel includes a data write module 21, a light emission control module 22 and a drive transistor T1. In the same row of pixel units 10, first control terminals P1A of data write modules 21A of sub-pixels 110 having a first color are connected to the same first scanning line Scan1; and first control terminals P1B of data write modules 21B of sub-pixels 111 having other colors except the sub-pixels having the first color are connected to the same second scanning line Scan2. The data write module 21 is configured to provide a data signal cached by a data line 30 for the drive transistor T1, the light emission control module 22 is connected in series respectively with the drive transistor T1 and the light-emitting element D, and the light emission control module 22 is configured to control whether a drive current flows through the light-emitting element D. The non-display region includes a multiplexer 40. The multiplexer 40 includes multiple data selection units 41. Each data selection unit 41 includes one input terminal. In and multiple output terminals Out. The multiple output terminals Out of each data selection unit 41 are electrically connected to multiple data lines 30 of the display region A in one-to-one correspondence. In the same row of pixel units 10, within time of one frame of a picture, time of providing data signals for data lines 30A connected to sub-pixels 110 having the first color is within the time of writing data signals cached by data lines 30B into pixel circuits 20B of sub-pixels 111 having the other colors.

As shown in FIG. 1, the display panel includes a display region A and a non-display region B, the non-display region B surrounds the display region A, the display region A includes pixel units 10 arranged in an array, and each pixel unit 10 includes sub-pixels 11 having multiple colors. The non-display region B includes a multiplexer 40, and the multiplexer 40 includes multiple data selection units 41. Merely one data selection unit 41 is illustrated in FIG. 1. In other embodiments, the multiplexer 40 may also include two or more data selection units 41, and each data selection unit 41 includes one input terminal. In and multiple output terminals Out. The multiple output terminals Out of each data selection unit 41 are electrically connected to multiple data lines 30 of the display region A in one-to-one correspondence. In FIG. 1, the number of output terminals Out of one data selection unit 41 is twelve, that is, one data selection unit 41 is electrically connected to twelve data lines 30 correspondingly. In the other embodiments, the number of output terminals Out of one data selection unit 41 may be three, six, or the like, which is not limited by the present disclosure. The multiple data selection units 41 are provided in the non-display region B of the display panel, the data signals of sub-pixels 11 located in the same row are input through the signal input terminal. In of one data selection unit 41 by using the multiplexer 40, so that the number of signal lines in the non-display region of the display panel is reduced, and the complexity of the circuit is reduced.

Referring to FIG. 1 and FIG. 2, each sub-pixel 11 includes the pixel circuit 20 and the light-emitting element D, each pixel circuit 20 includes the data write module 21, the light emission control module 22 and the drive transistor T1. In the same row of pixel units 10, the first control terminals P1A of the data write modules 21A of the sub-pixels 110 having the first color are connected to the same first scanning line Scan1, and the first control terminals P1B of the data write modules 21B of the sub-pixels 111 having the other colors except the sub-pixels having the first color are connected to the same second scanning line Scan2.

Referring to FIG. 1 and FIG. 3, control lines (such as CK1 to CK12) are electrically connected to control terminals of the data selection unit 41, and the number of the control lines is set to be the same as the number of output terminals Out of the data selection unit 41. The control lines are configured to control one output terminal of the data selection unit 41 to output the data signal to a data line 30 corresponding to the one output terminal.

Light emissions by sub-pixels 11 having different colors have different influences on the display effect of the display panel within the time of one frame of the picture. In the present application, the first control terminals P1A of the data write modules 21A of the sub-pixels 110 having the first color which have the smaller influence on the display effect of the display panel are set to be connected to the same first scanning line Scan1, and the first control terminals P1B of the data write modules 21B of the sub-pixels 111 having the other colors except the sub-pixels having the first color are connected to the same second scanning line Scan2. Referring to FIGS. 1 to 3, in a first data cache stage T11, the data signals are provided for data lines 30B connected to the sub-pixels 111 having the other colors except the sub-pixels having the first color through the data selection units 41, that is, one potential signal is provided for the control terminals of the data selection units 41 corresponding to the data lines 30B connected to the sub-pixels 111 having the other colors. The control lines electrically connected to the control terminals of the data selection units 41 corresponding to the sub-pixels 111 having the other colors are CK1, CK2, CK4, CK5, CK7, CK8, CK10 and CK11, respectively. Through providing the potential signal for the control lines electrically connected to the control terminals of the data selection units 41 corresponding to the sub-pixels 111 having the other colors, the data selection units 41 corresponding to the sub-pixels 111 having the other colors are controlled to be turned on, so as to enable the data lines 30B connected to the sub-pixels 111 having the other colors to receive the data signals to perform caching. In a second data cache stage T12, the data signals are provided for the data lines 30A connected to the sub-pixels 110 having the first color through the data selection units 41, that is, the one potential signal is provided for the control terminals of the data selection units 41 corresponding to the data lines 30A connected to the sub-pixels 110 having the first color. The control lines electrically connected to the control terminals of the data selection units 41 corresponding to the sub-pixels 110 having the first color are CK3, CK6, CK9 and CK12, respectively. Through providing the potential signal for the control lines electrically connected to the control terminals of the data selection units 41 corresponding to the sub-pixels 110 having the first color, the data selection units 41 corresponding to the sub-pixels 110 having the first color are controlled to be turned on, so as to enable the data lines 30A connected to the sub-pixels 110 having the first color to receive the data signals to perform caching. In the first data cache stage T11, the data signals have been received and cached by the data lines 30B connected to the sub-pixels 111 having the other colors except the sub-pixels having the first color. At this time, the data write modules 21B in the pixel circuits 20B corresponding to the sub-pixels 111 having the other colors which are electrically connected to the second scanning lines Scan2 are controlled to be turned on by controlling the second scanning lines Scan2 connected to the sub-pixels 111 having the other colors except the sub-pixels having the first color to output scanning signals. In so doing, the data write modules 21B corresponding to the sub-pixels 111 having the other colors provide the data signals cached by the data lines 30B corresponding to the sub-pixels 111 having the other colors for drive transistors T1B of the pixel circuits 20B corresponding to the sub-pixel 111 having the other colors. After the data signals have been received and cached by the data lines 30A connected to the sub-pixels 110 having the first color, the data write modules 21A in the pixel circuits 20A corresponding to the sub-pixels 110 having the first color which are electrically connected to the first scanning lines Scan1 are controlled to be turned on by controlling the first scanning lines Scan1 connected to the sub-pixels 110 having the first color to output first scanning signals, so that the data write modules 21A corresponding to the sub-pixels 110 having the first color provide the data signals cached by the data lines 30A corresponding to the sub-pixels 110 having the first color for drive transistors T1A of the pixel circuits 20A corresponding to the sub-pixels 110 having the first color. The sub-pixels 111 having the other colors which have the greater influence on the display effect of the display panel are configured to perform the data signal cache on the data lines 30B first, after the sub-pixels 111 having the other colors complete the data cache, the data cache of the sub-pixels 110 having the first color which have the smaller influence on the display effect of the display panel is performed. The data cache of the sub-pixels 110 having the first color is simultaneously performed with outputting control signals to the first control terminals P1B of the data write modules 21B corresponding to the sub-pixels 111 having the other colors through the second scanning lines Scan2 to control the data write modules 21B corresponding to the sub-pixels 111 having the other colors to be turned on. So that the data write modules 21B in the pixel circuits 20B corresponding to the sub-pixels 111 having the other colors provide the data signals cached by the data lines 30B for the drive transistors T1B, thus increasing the data write time of the sub-pixels 111 having the other colors, ensuring the charging time of the drive transistors T1B in the pixel circuits 20B corresponding to the sub-pixels 111 having the other colors, and improving the display effect of the display panel.

It is to be noted that merely one data selection unit 41 is illustrated in FIG. 1. In other embodiments, the multiplexer 40 may also include two or more data selection units 41, and the multiple output terminals Out of each data selection unit 41 are electrically connected to multiple data lines 30 of the display region A in one-to-one correspondence. In FIG. 1, the number of output terminals Out of one data selection unit 41 is twelve, that is, one data selection unit 41 is electrically connected to twelve data lines 30 correspondingly. In the other embodiments, the number of output terminals Out of one data selection unit 41 may be three, six, or the like, which is not limited by the present disclosure.

In the display panel provided in the embodiments of the present disclosure, according to the influence of sub-pixels having different colors on the display screen of the display panel, the sub-pixels having the smaller influence on the display screen of the display panel are selected as the sub-pixels having the first color, and the sub-pixels having greater influences on the display screen of the display panel are selected as the sub-pixels having the other colors within the time of one frame of the picture. The time of providing the data signals for the data lines connected to the sub-pixels having the first color having the smaller influence on the display screen of the display panel is within the time of writing the data signals cached by the data lines into the pixel circuits of the sub-pixels having the other colors, that is, the display panel first provides the data signals for the data lines connected to the sub-pixels having the other colors, and after providing the data signals for the data lines connected to the sub-pixels having the other colors is completed, the data signals are provided for the data lines connected to the sub-pixels having the first color. Since the sub-pixels having the other colors have completed providing the data signals for the data lines corresponding connected to the sub-pixels having the other colors, providing the data signals for the data lines connected to the sub-pixels having the first color can be simultaneous with outputting control signals to first control terminals of the data write modules corresponding to the sub-pixels having the other colors through the second scanning lines to control the data write modules corresponding to the sub-pixels having the other colors to be turned on, so as to achieve providing the data signals cached by the data lines for the drive transistors by the data write modules in the pixel circuits corresponding to the sub-pixels having the other colors. Since the time of writing the data signals cached by the data lines of the sub-pixels having the other colors into the drive transistors is increased, the data writing time corresponding to the sub-pixels having the other colors which have the greater influence on the display effect of the display panel is ensured, charging time of the driving transistors in the pixel circuits corresponding to the sub-pixels having the other colors is increased, and the display effect of the display panel is ensured.

Referring to FIG. 2 and FIG. 3, in the same row of pixel units, within the time of one frame of the picture, start time of an effective pulse of the second scanning line Scan2 is earlier than start time of an effective pulse of the first scanning line Scan1.

As shown in FIG. 2, the first control terminals NA of the data write modules 21A of the sub-pixels 110 having the first color are connected to the same first scanning line Scan1, and the first control terminals P1B of the data write modules 21B of the sub-pixels 111 having the other colors except the first color are connected to the same second scanning line Scan2. After the data signals are provided for the data lines 30B corresponding to the sub-pixels 111 having the other colors, the second scanning lines Scan2 are controlled to output control signals for the first control terminals P1B of the data write modules 21B corresponding to the sub-pixels 111 having the other colors to control the data write modules 21B corresponding to the sub-pixels 111 having the other colors to be turned on, so that the data write modules 21B in the pixel circuits 20B corresponding to the sub-pixels 111 having the other colors provides the data signals cached by the data lines 30B for the drive transistors T1B. Since the second scanning lines Scan2 output the control signals to the first control terminals P1B of the data write modules 21B corresponding to the sub-pixels 111 having the other colors to control the data write modules 21B corresponding to the sub-pixels 111 having the other colors to be turned on, the data signals are simultaneously provided for the data lines 30A corresponding to the sub-pixels 110 having the first color. After writing the data cache signals into the data lines 30A corresponding to the sub-pixels 110 having the first color has been completed, the first scanning lines Scan1 output the control signals to the first control terminals NA of the data write modules 21A corresponding to the sub-pixels 110 having the first color to control the data write modules 21A corresponding to the sub-pixels 110 having the first color to be turned on, so as to perform the data writing. Therefore, in the same row of pixel units, within the time of one frame of the picture, the start time of the effective pulse of the second scanning line Scan2 is earlier than the start time of the effective pulse of the first scanning line Scan1.

Referring to FIG. 2 and FIG. 3, in the same row of pixel units, within the time of one frame of the picture, start time of providing the data signals for the data lines 30B connected to the sub-pixels 111 having the other colors is earlier than start time of providing the data signals for the data lines 30A connected to the sub-pixels 110 having the first color.

Since the sub-pixels 111 having the other colors have the greater influence on the display effect of the display panel, in order to ensure the display effect of the display panel, the start time of providing the data signals to the data lines 30B connected to the sub-pixels 111 having the other colors is controlled to be earlier than the start time of providing the data signals to the data lines 30A connected to the sub-pixels 110 having the first color, that is, the data signals are provided for the data lines 30B connected to the sub-pixels 111 having the other colors first. After providing the data signals for the data lines 30B connected to the sub-pixels 111 having the other colors has been completed, the data signals are provided for the data lines 30A connected to the sub-pixels 110 having the first color, and while providing the data signals for the data lines 30A connected to the sub-pixels 110 having the first color, the second scanning lines Scan2 are controlled to output the control signals to the first control terminals P1B of the data write modules 21B corresponding to the sub-pixels 111 having the other colors to control the data write modules 21B corresponding to the sub-pixels 111 having the other colors to be turned on, so that the data write modules 21B in the pixel circuits 20B corresponding to the sub-pixels 111 having the other colors provide the data signals cached by the data lines 30B for the drive transistors T1B. After providing the data signals for the data lines 30A connected to the sub-pixels 110 having the first color has been completed, the data write modules 21A in the pixel circuits 20A corresponding to the sub-pixels 110 having the first color provide the data signals cached by the data lines 30A for the drive transistors T1A. After providing the data signals for the data lines 30B connected to the sub-pixels 111 having the other colors has been completed, the data write modules 21B in the pixel circuits 20B corresponding to the sub-pixels 111 having the other colors provide the data signals cached by the data lines 30B for the drive transistors T1B, so that the time of providing the data signals cached by the data lines 30B for the drive transistors T1B by the data write modules 21B in the pixel circuits 20B corresponding to the sub-pixels 111 having the other colors changes from original time T22 to time T21, thus increasing the time of the data write modules 21B in the pixel circuits 20B corresponding to the sub-pixels 111 having the other colors to provide the data signals cached by the data lines 30B for the drive transistors T1B, preventing the sub-pixels 111 having the other colors which have the greater influence on the display effect of the display panel from affecting the data signals written into the drive transistors T1B due to insufficient charging time of the scanning signals of the first control terminals P1B of the data write modules 21B, thus affecting the display effect of the display panel.

Still referring to FIG. 3, in the same row of pixel units, within the time of one frame of the picture, providing the data signals for the data lines 30A connected to the sub-pixels 110 having the first color is simultaneous with providing an effective pulse for the second scanning line Scan2.

Exemplarily, as shown in FIG. 3, within the T12 time, the control lines (e.g., CK3, CK6, CK9, and CK12) electrically connected to the control terminals of the data selection units 41 corresponding to the sub-pixels 110 having the first color are in an enabled state, at this time, the data selection units 41 corresponding to the sub-pixels 110 having the first color are in a turned-on state, and the data selection units provide the data signals for the data lines 30A connected to the sub-pixel 110 having the first color. Providing the effective pulse for the second scanning lines Scan2 is simultaneous with providing the data signals for the data lines 30A connected to the sub-pixels 110 having the first color, so as to enable the second scanning lines Scan2 to output the control signals to the first control terminals P1B of the data write modules 21B corresponding to the sub-pixels 111 having the other colors to control the data write modules 21B corresponding to the sub-pixels 111 having the other colors to be turned on. Thus the data write modules 21B in the pixel circuits 20B corresponding to the sub-pixels 111 having the other colors provide the data signals cached by the data lines 30B for the drive transistors T1B.

In the same row of pixel units, within the time of one frame of the picture, end time of the effective pulse of the second scanning line Scan2 may be the same as end time of the effective pulse of the first scanning line Scan1.

Still referring to FIG. 3, the end time of the effective pulse of the second scanning line Scan2 is set to be the same as the end time of the effective pulse of the first scanning line Scan1, so that in the same row of pixel units, sub-pixels having different colors complete the data writing simultaneously within the time of one frame of the picture.

Figure 4:
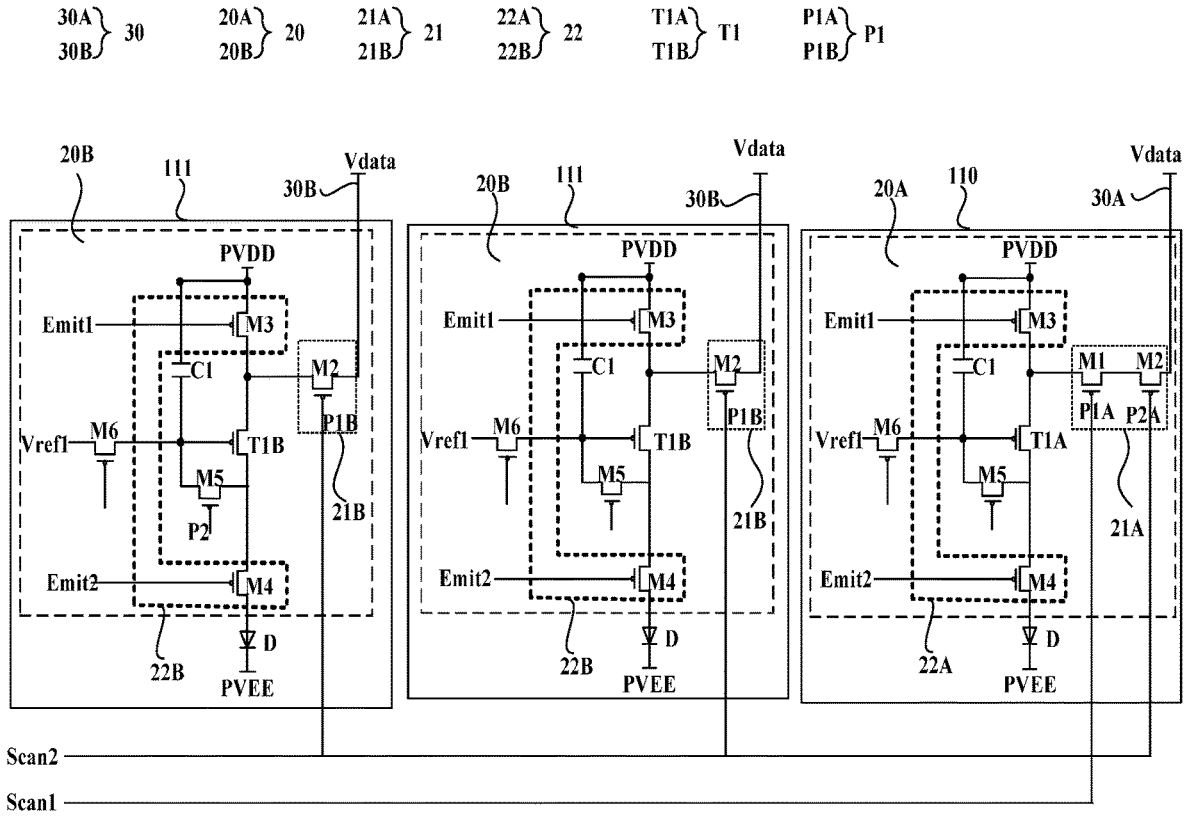
FIG. 4 is a structure diagram of pixel circuits in one pixel unit in another display panel according to an embodiment of the present disclosure.

On the basis of the preceding embodiments, FIG. 4 is a structure diagram of pixel circuits in one pixel unit in another display panel according to an embodiment of the present disclosure. As shown in FIG. 4, the data write module 21A in the pixel circuit 20A of each sub-pixel 110 having the first color further includes a second control terminal P2A, the second control terminal P2A is electrically connected to the second scanning line Scan2, and when both the first scanning line Scan1 and the second scanning line Scan2 have effective pulses simultaneously, the data write module 21A of each sub-pixel 110 having the first color is turned on.

Exemplarily, as shown in FIG. 4, the data write module 21A in the pixel circuit 20A of each sub-pixel 110 having the first color further includes the second control terminal P2A, the second control terminal P2A is electrically connected to the second scanning line Scan2. When the second scanning line Scan2 provides an effective pulse signal and the first scanning line Scan1 provides an ineffective pulse signal, the data write modules 21B in the pixel circuits 20B of the sub-pixels 111 having the other colors are turned on and the data write modules 21A in the pixel circuits 20A of the sub-pixels 110 having the first color are not turned on. When the first scanning line Scan1 and the second scanning line Scan2 have the effective pulses simultaneously, the data write modules 21A of the sub-pixels 110 having the first color are turned on.

It is to be noted that in the case where the data write module 21A in the pixel circuit 20A of each sub-pixel 110 having the first color further includes the second control terminal P2A, the corresponding timing diagram is the same as FIG. 3. As shown in FIG. 3, in the case where the second scanning line Scan2 has the effective pulse, second transistors M2 in both the data write modules 21A corresponding to the sub-pixels 110 having the first color and the data write modules 21B corresponding to the sub-pixels 111 having the other colors which are electrically connected to the second scanning lines Scan2 are turned on, and the data signals cached by the data lines 30B corresponding to the sub-pixels 111 having the other colors are provided for the drive transistors T1B. However, since the data write module 21A of each sub-pixel 110 having the first color further includes a first transistor M1 and the first scanning line Scan1 electrically connected to a control terminal of the first transistor M1 has the ineffective pulse, the data write modules 21A of the sub-pixels 110 having the first color are not turned on.

Still referring to FIG. 2, the data write module 21A of each sub-pixel 110 having the first color includes the first transistor M1, the data write module 21B of each sub-pixel 111 having the other colors includes a second transistor M2, a control terminal of the first transistor M1 is electrically connected to the first scanning line Scan1, and a control terminal of the second transistor M2 is electrically connected to the second scanning line Scan2.

Exemplarily, as shown in FIG. 2, the data write module 21A of each sub-pixel 110 having the first color is set to include the first transistor M1, the data write module 21B of each of the sub-pixels 111 having the other colors is set to include the second transistor M2, the control terminal of the first transistor M1 is electrically connected to the first scanning line Scan1, and the control terminal of the second transistor M2 is electrically connected to the second scanning line Scan2. When the first scanning line Scan1 has the effective pulse, first transistors M1 of data write modules 21A corresponding to the sub-pixels 110 having the first color electrically connected to the first scanning lines Scan1 are turned on, the data signals cached by the data lines 30A corresponding to the sub-pixels 110 having the first color are provided for the drive transistors T1A. When the second scanning line Scan2 has the effective pulse, second transistors M2 in data write modules 21B corresponding to the sub-pixels 111 having the other colors electrically connected to the second scanning line Scan2 are turned on, and the data signals cached by the data lines 30B corresponding to the sub-pixels 111 having the other colors are provided for the drive transistors T1B.

As shown in FIG. 4, the data write module 21A of each sub-pixel 110 having the first color includes the first transistor M1 and the second transistor M2, the data write module 21B of each of the sub-pixels 111 having the other colors includes the second transistor M2, the control terminal of the first transistor M1 is electrically connected to the first scanning line Scan1, and the control terminal of the second transistor M2 is electrically connected to the second scanning line Scan2.

Exemplarily, as shown in FIG. 4, the data write module 21A of each sub-pixel 110 having the first color is set to include the first transistor M1 and the second transistor M2, the data write module 21B of each of the sub-pixels 111 having the other colors is set to include the second transistor M2, the control terminal of the first transistor M1 is electrically connected to the first scanning line Scan1, and the control terminal of the second transistor M2 is electrically connected to the second scanning line Scan2. When the second scanning line Scan2 has the effective pulse, second transistors M2 in the data write modules 21A corresponding to the sub-pixels 110 having the first color and the data write modules 21B corresponding to the sub-pixels 111 having the other colors, which are electrically connected to the second scanning lines, are turned on, and the data signals cached by the data lines 30B corresponding to the sub-pixels 111 having the other colors are provided for the drive transistors T1B. Since the data write module 21A of each sub-pixel 110 having the first color further includes the first transistor M1 and the first scanning line Scan1 electrically connected to the control terminal of the first transistor M1 has the ineffective pulse, the data write module 21A of each sub-pixel 110 having the first color is not turned on. When both the first scanning line Scan1 electrically connected to the control terminal of the first transistor M1 and the second scanning line Scan2 electrically connected to the control terminal of the second transistor M2 are effective pulses, the data signals cached by the data lines 30A corresponding to the sub-pixels 110 having the first color are provided for the drive transistors T1A.

The sub-pixels 110 having the first color may have the smallest light-emitting efficiency.

Through setting the sub-pixels 110 having the first color as sub-pixels having the smallest light-emitting efficiency in the display panel, that is, the sub-pixels having the first color have the least influence on the display effect of the display panel, even if the charging time of the scanning signals of the first control terminals NA of the data write modules 21A corresponding to the sub-pixels 110 having the first color is insufficient, the sub-pixel having the first color has the smaller influence on the display effect of the display panel, therefore, it is difficult for human eyes to detect it, and the display effect of the display panel is ensured.

Figure 5:
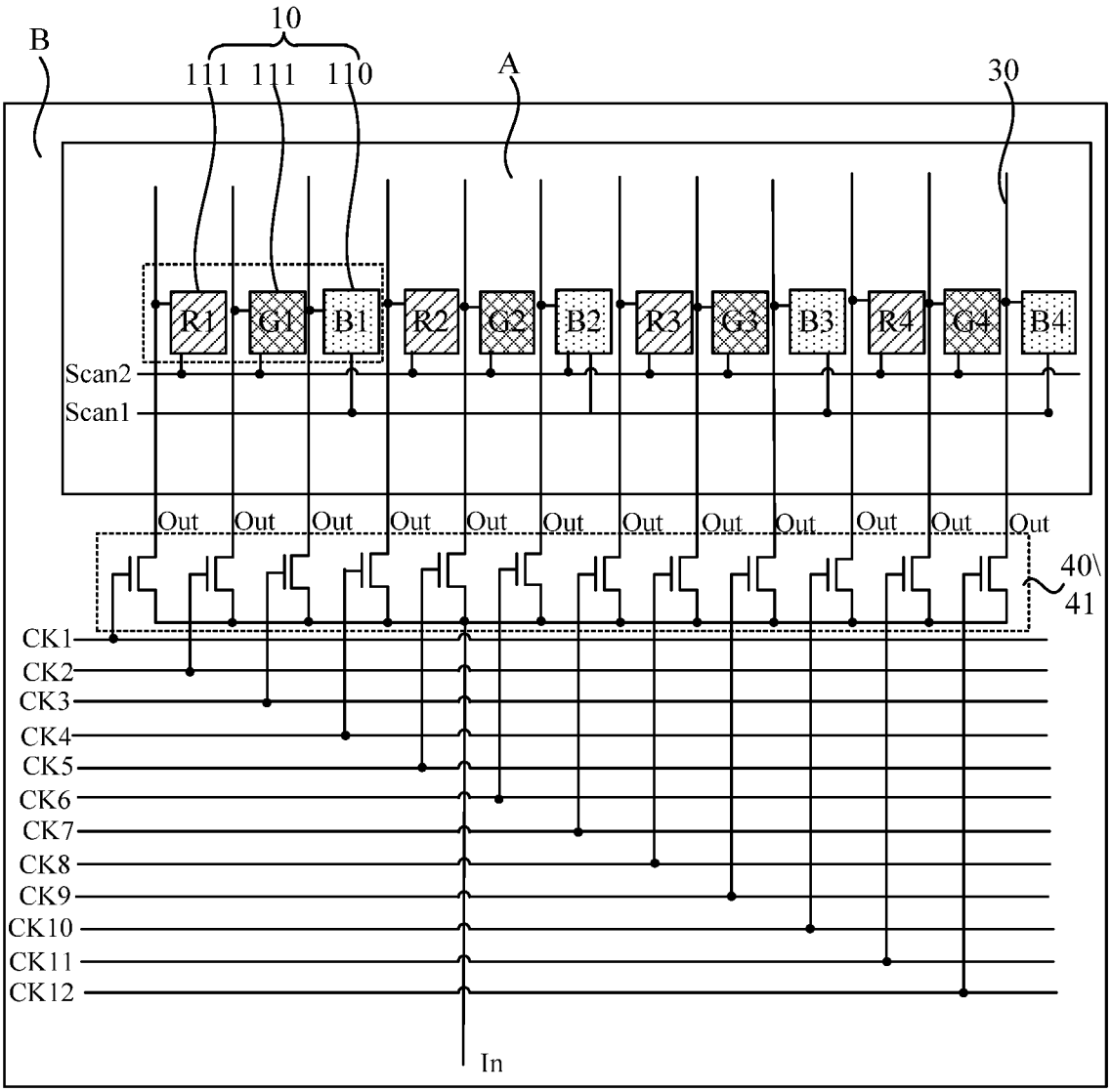
FIG. 5 is a structure diagram of another display panel according to an embodiment of the present disclosure.

Based on the preceding embodiments, FIG. 5 is a structure diagram of another display panel according to an embodiment of the present disclosure. As shown in FIG. 5, the sub-pixels 110 having the first color include blue sub-pixels B, and the sub-pixels 111 having the other colors include red sub-pixels R and green sub-pixels G.

Exemplarily, in FIG. 5, in the same row of pixel units, the red sub-pixels include R1, R2, R3 and R4, the green sub-pixels include G1, G2, G3 and G4, and the blue sub-pixels includes B1, B2, B3 and B4.

It is to be noted that when the pixel units in the display panel include the red sub-pixels R, the green sub-pixels G and the blue sub-pixels B, the sub-pixels 110 having the first color are the blue sub-pixels B and the sub-pixels 111 having the other colors are the red sub-pixels R and the green sub-pixels G accordingly. In other embodiments, if the pixel units in the display panel include yellow sub-pixels, cyan sub-pixels and pink sub-pixels, the sub-pixels 110 having the first color are the cyan sub-pixels and the sub-pixels 111 having the other colors are the pink sub-pixels R and the yellow sub-pixels G accordingly. Colors of the sub-pixels having the first color and the sub-pixels having other colors are not limited by the embodiments of the present disclosure, and the skilled person in the art may set the colors according to the adaptation scene of the display panel.

The drive transistor T1A in the sub-pixels 110 having the first color may have a width-to-length ratio of a channel region smaller than a width-to-length ratio of a channel region of the drive transistor T1B in the sub-pixels 111 having the other colors.

The width-to-length ratio (W/L) of the channel region A of the drive transistor refers to a ratio of the width W to the length L of an overlapping region where both a semiconductor layer of the drive transistor and a gate of the drive transistor are located, the width of the channel region A refers to a size of the overlapping region in a direction extending along the gate of the driving transistor, and the length of the channel region A refers to a size of the overlapping region in a direction extending along the semiconductor layer of the driving transistor.

Since a white electroluminescent device in the related art differs from a standard white electroluminescent device at certain wavelengths, the light emission brightness corresponding to a sub-pixel region of each color may be different in the case of providing the same data voltage for sub-pixels having different colors. Therefore, the channel regions of the driving transistors in the pixel circuits corresponding to the sub-pixels having the first color and the sub-pixels having the other colors are designed in the present disclosure, the width-to-length ratio of the channel region in a sub-pixel region having the small light emission brightness is increased, thereby increasing the drive current provided by the drive transistor of the sub-pixel region to compensate the loss in the waveband, so as to enable the light emission brightness of the sub-pixel region of each color to tend to be consistent when the sub-pixel region of each color is driven by the same data voltage, and improve the display quality.

Since the pixels corresponding to the sub-pixels 110 having the other colors have greater influence on the display effect of the display panel, the light emission efficiency of the sub-pixels 110 having other colors can be ensured by increasing the width-to-length ratio of the channel region in the pixel circuits 20A corresponding to the sub-pixels 111 having the other colors, thereby ensuring the display effect of the display panel.

The width-to-length ratio of the channel region of the drive transistor T1A in the sub-pixels 110 having the first color may be A1, and the width-to-length ratio of the channel region of the drive transistor T1B in the sub-pixels 111 having the other colors may be A2, where $8 \leq A2 - A1 \leq 12$.

The width-to-length ratio A1 of the channel region of the drive transistor T1A in the sub-pixels 110 having the first color and the width-to-length ratio A2 of the channel region of the drive transistor T1B in the sub-pixels 111 having the other colors are configured to satisfy: $8 \leq A2 - A1 \leq 12$, that is, by reducing the width-to-length ratio of the channel region of the drive transistor T1A of the sub-pixels 110 having the first color, the reduced channel region can be used for arranging the second transistor newly added by the data write module of each sub-pixel having the first color under the condition that the display of the display panel is not affected.

Figure 6:
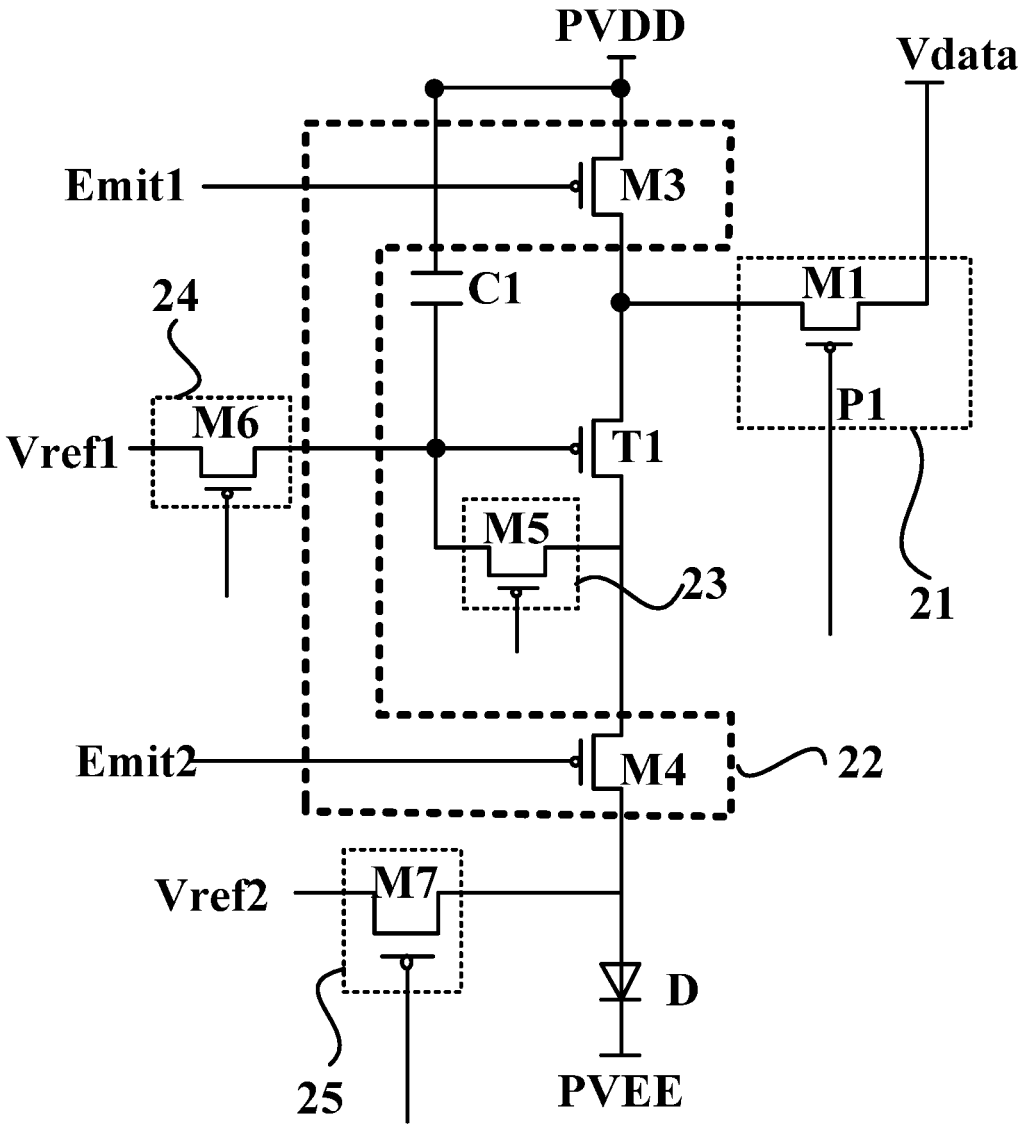
FIG. 6 is a structure diagram of a pixel circuit according to an embodiment of the present disclosure.

On the basis of the preceding embodiments, FIG. 6 is a structure diagram of a pixel circuit according to an embodiment of the present disclosure. As shown in FIG. 6, the pixel circuit further includes a threshold compensation module 23, a first reset module 24 and a second reset module 25. The light emission control module 22 includes a third transistor M3 and a fourth transistor M4, the threshold compensation module 23 includes a fifth transistor M5, the first reset module 24 includes a sixth transistor M6, and the second reset module 25 includes a seventh transistor M7.

Exemplarily, as shown in FIG. 6, the threshold compensation module 23 is connected in series between the control terminal of the first drive transistor T1 and the second terminal of the first drive transistor T1, and the threshold compensation module 23 is configured to detect and self-compensate for an offset of the threshold voltage of the drive transistor T1.

In order to prevent the voltage of the control terminal of the first drive transistor T1 from affecting the display of the next frame picture when the previous frame picture is displayed, in the embodiment of the present disclosure, the control terminal of the first drive transistor T1 is reset through the first reset module 24 before the data signal is provided for the first drive transistor T1.

Before the light emission stage, an electrode voltage of the light-emitting element D may be reset by the second reset module 25 so that the potential on the electrode of the light-emitting element D in the previous drive period is prevented from affecting the image display in the current drive period.

Still referring to FIG. 6, a first terminal of the third transistor M3 is electrically connected to an input terminal PVDD of a first-level signal, a second terminal of the third transistor M3 is electrically connected to the first terminal of the drive transistor T1, a first terminal of the fourth transistor M4 is electrically connected to a second terminal of the drive transistor T1, and a second terminal of the fourth transistor M4 is electrically connected to the light-emitting element D. A first terminal of the fifth transistor M5 is electrically connected to the second terminal of the drive transistor T1, and a second terminal of the fifth transistor M5 is electrically connected to the control terminal of the drive transistor T1. A first terminal of the sixth transistor is electrically connected to a first reset signal terminal Vref1, and a second terminal of the sixth transistor M6 is electrically connected to the control terminal of the drive transistor T1. A first terminal of the seventh transistor M7 is electrically connected to a second reset signal terminal Vref2, and a second terminal of the seventh transistor M7 is electrically connected to the light-emitting element D.

In the data write stage and stages before the data write stage, the third transistor M3 and the fourth transistor M4 are turned off; and in the light emission stage, the third transistor M3 and the fourth transistor M4 are turned on to enable the drive transistor T1 to drive the light-emitting element D to emit light.

In the data write stage, when the control terminal of the fifth transistor M5 in the threshold compensation module receives the control signal to be turned on, the data voltage signal provided for the drive transistor T1 by the data write module 21 is written into the control terminal of the drive transistor T1 through the fifth transistor M5.

Before the data voltage signal is provided for the first drive transistor T1, the sixth transistor M6 in the first reset module 24 is controlled to be turned on by the control signal, a reset signal inputted by the first reset signal terminal Vref1 is transmitted to the control terminal of the drive transistor T1, and the control terminal of the drive transistor T1 is reset.

Before the light emission stage, the seventh transistor M7 in the second reset module 25 is controlled to be turned on by the control signal, and the second reset signal terminal Vref2 transmits the reset signal to the light-emitting element D to reset the light-emitting element D.

It is to be noted that FIG. 6 exemplarily shows that the control terminal of the third transistor M3 and the control terminal of the fourth transistor M4 are respectively connected to a light emission control signal input terminal Emit1 and a light emission control signal input terminal Emit2. In other embodiments, the control terminal of the third transistor M3 and the control terminal of the fourth transistor M4 may be connected to the same light emission control signal input terminal. That is, the turn-on or off of the third transistor M3 and the fourth transistor M4 is controlled through the same light emission control signal. Such configurations can reduce the number of wires in the panel. In addition, for a panel having the low-frequency display, the flicker limitation caused by the hysteresis effect of the drive transistor is more easily perceived by human eyes due to the low frequency. It is possible to input multiple pulse waves having the high-low-level switching in the light emission stage through the light emission control signal input terminal, so that the light-emitting element can emit and cut off multiple times in the light emission stage, thereby avoiding the flicker phenomenon perceived by human eyes. The control terminal of the third transistor M3 and the control terminal of the fourth transistor M4 both are controlled by the same light emission control signal, and the above-mentioned flicker phenomenon can be alleviated by setting the light emission control signal as the multiple pulse waves having the high-low-level switching in the light emission stage.

Further, the control terminal of the sixth transistor M6 and the control terminal of the seventh transistor M7 may be configured to receive a reset signal output by the same reset signal terminal, thus reducing the number of signal lines in the display panel.

The multiple output terminals of the data selection unit may have a number of n, where $n \geq 6$.

When the multiple output terminals of the data selection unit in the display panel have the number of n, and $n \geq 6$, for the display panel, it is necessary to provide a data signal for a data line correspondingly connected to a data selection unit through the data selection unit, and the data signal cached by the data line is written into each sub-pixel after providing the data signal for the data line completed. So that within the time of scanning one row of pixels, the time of writing the data signal cached by the data line into each sub-pixel is reduced, resulting in a serious shortage of the time of writing the data signal cached by the data line into each sub-pixel.

Within the time of one frame of the picture, the start time of the effective pulse of the second scanning line Scan2 is t1, the start time of the effective pulse of the first scanning line Scan1 is t2, each data selection unit 41 has n output terminals Out connected to the data lines of the sub-pixels having the first color, and time of providing the data signal for a data line 30A which corresponds to one sub-pixel 110 having the first color and is connected to one of the output terminals Out of the data selection unit is a1, where $t1-t2=a1 \cdot n$.

Exemplarily, referring to FIG. 1 and FIG. 3, when output terminals Out of each data selection unit which are connected to the data lines of the sub-pixels 110 having the first color have the number of n, the data signals are provided for the data lines 30A connected to the sub-pixels 110 having the first color, while an effective pulse is provided for the second scanning line Scan2, and an effective pulse is provided for the first scan line Scan1 after the data signals have been provided for the data lines 30A connected to the sub-pixels 110 having the first color, the start time t1 of the effective pulse provided for the second scanning line Scan2 and the start time t2 of the effective pulse provided for the first scanning line Scan1 satisfy that t1·t2=a1·n, that is, the multiple data selection units 41 provide the data signals for the data lines 30A connected to the sub-pixels 110 having the first color before providing the effective pulse for the first scanning line Scan1.

Figure 7:
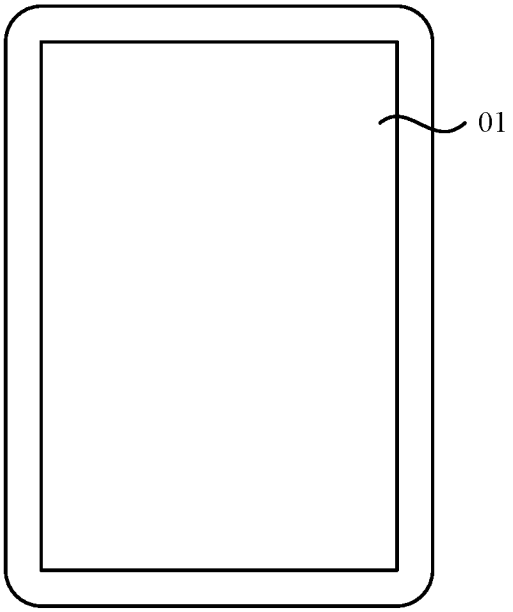
FIG. 7 is a structure diagram of a display device according to an embodiment of the present disclosure.

On the basis of the preceding embodiments, a display device is further provided in the embodiments of the present disclosure. As shown in FIG. 7, the display device includes the display panel 01 provided in the embodiments of the present disclosure, so the display device also has the beneficial effects of the display panel 01 provided in the embodiments of the present disclosure, and the same portions can be understood with reference to the above description and are not described in detail below.

It is to be noted that the display device provided in the embodiments of the present disclosure may be a mobile phone, a tablet computer, a smart wearable device (such as a smart watch) and other products or components having display functions and known to those skilled in the art, and is not limited in the embodiments of the present disclosure.

Figure 8:
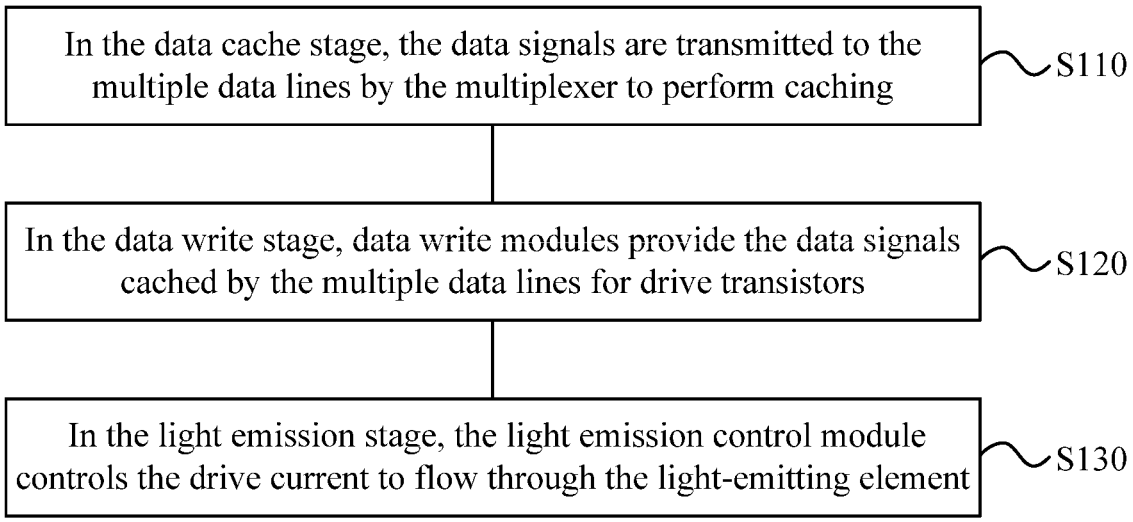
FIG. 8 is a flowchart of a driving method of a display panel according to an embodiment of the present disclosure.
Figure 9:
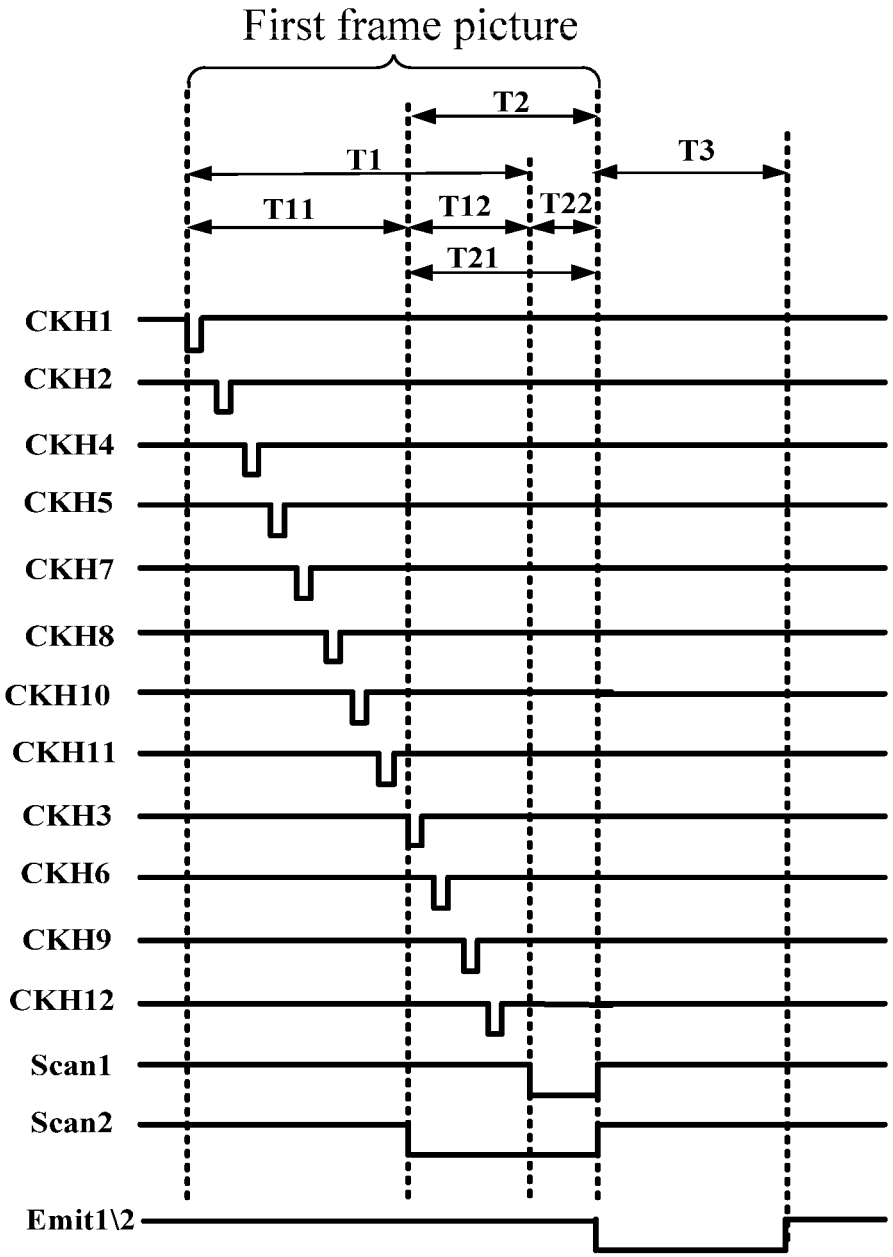
FIG. 9 is a driving timing diagram of the driving method of the display panel shown in FIG. 8.

On the basis of the preceding embodiments, FIG. 8 is a flowchart of a driving method of a display panel according to an embodiment of the present disclosure and FIG. 9 is a driving timing diagram of a driving method of the display panel shown in FIG. 8. Referring to FIG. 8 and FIG. 9, a drive cycle of the display panel includes a data cache stage, a data write stage and a light emission stage. The driving method includes the steps described below.

In S110, in the data cache stage, the multiplexer transmits the data signals to the multiple data lines to perform caching.

Using the structure of the pixel circuit shown in FIG. 2 as an example, combining with FIG. 9, in the data cache stage T1, an enable signal is received by a control terminal of the multiplexer which is connected to the data lines of the sub-pixels 111 having the other colors in a first data cache stage T11, and the multiplexer provides the data signals for the data lines 30B connected to the sub-pixels 111 having the other colors. An enable signal is received by a control terminal of the multiplexer which is connected to the data lines of the sub-pixels 110 having the first color in a second data cache stage T12, and the multiplexer provides the data signals for the data lines 30A connected to the sub-pixels 110 having the first color.

In S120, in the data write stage, data write modules provide the data signals cached by the multiple data lines for drive transistors.

Using the structure of the pixel circuit shown in FIG. 2 as an example, combining with FIG. 9, in the data write stage T2, the data write module 21B in the pixel circuit 20B provides the data signal for the first drive transistor T1B, and the data write module 21A in the pixel circuit 20A provides the data signal for the first drive transistor T1A in the data write stage T22.

In S130, in the light emission stage, the light emission control module controls the drive current to flow through the light-emitting element.

In the same row of pixel units, within the time of one frame of the picture, the time of providing the data signals for the data lines connected to the sub-pixels having the first color is within the time of writing the data signals cached by the data lines into pixel circuits of the sub-pixels having the other colors.

The driving method of the display panel is provided in the embodiments of the present disclosure, according to the influences of sub-pixels having different colors on the display screen of the display panel, the sub-pixels having the smaller influence on the display screen of the display panel are selected as the sub-pixels having the first color, and the sub-pixels having the greater influence on the display screen of the display panel are the sub-pixels having the other colors within the time of one frame of the picture. The time of providing the data signals for the data lines connected to the sub-pixels having the first color which have the smaller influence on the display screen of the display panel is within the time of writing the data signals cached by the data lines into the pixel circuits of the sub-pixels having the other colors. That is to say, the display panel first provides the data signals for the data lines connected to the sub-pixels having the other colors, and after the data signals are provided for the data lines connected to the sub-pixels having the other colors, the data signals are provided for the data lines connected to the sub-pixels having the first color. Since the sub-pixels having the other colors have completed providing the data signals for the data lines corresponding connected to the sub-pixels having the other colors, outputting control signals to the first control terminals of the data write modules corresponding to the sub-pixels having the other colors through the second scanning lines to control the data write modules corresponding to the sub-pixels having the other colors to be turned on is simultaneous with providing the data signals for the data lines connected to the sub-pixels having the first color, so as to achieve the data write modules in the pixel circuits corresponding to the sub-pixels having the other colors providing the data signals cached by the data lines for the drive transistors. Since the time of writing the data signals cached by the data lines of the sub-pixels having the other colors into the drive transistors is increased, the data writing time corresponding to the sub-pixels having the other colors which have the greater influence on the display effect of the display panel is ensured, the charging time of the driving transistors in the pixel circuits corresponding to the sub-pixels having the other colors is increased, and the display effect of the display panel is ensured.

Figure 10:
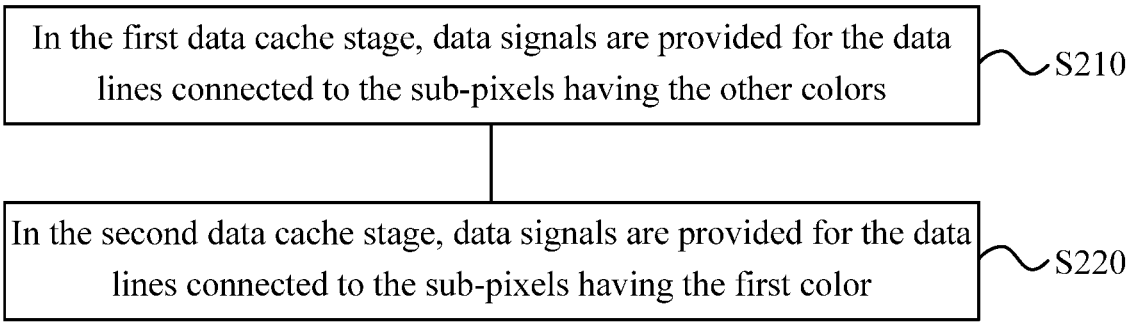
FIG. 10 is a flowchart of another driving method of a display panel according to an embodiment of the present disclosure.

On the basis of the preceding embodiments, FIG. 10 is a flowchart of another driving method of a display panel according to an embodiment of the present disclosure. In the same row of pixel units, within the time of one frame of the picture, start time of providing the data signals for the data lines connected to the sub-pixels having the other colors is earlier than start time of providing the data signals for the data lines connected to the sub-pixels having the first color, and the data cache stage includes a first data cache stage and a second data cache stage. As shown in FIG. 10, the driving method includes steps described below.

In S210, in the first data cache stage, the data signals are provided for the data lines connected to the sub-pixels having the other colors.

Since the sub-pixels 111 having the other colors have the greater influence on the display effect of the display panel, in order to ensure the display effect of the display panel, the start time of providing the data signals for the data lines 30B connected to the sub-pixels 111 having the other colors is controlled to be earlier than the start time of providing the data signals for the data lines 30A connected to the sub-pixels 110 having the first color. In other words, the data signals are first provided for the data lines 30B connected to the sub-pixels 111 having the other colors in the first data cache stage T11.

In S220, in the second data cache stage, the data signals are provided for the data lines connected to the sub-pixels having the first color.

Referring to FIG. 9 and FIG. 10, after the data signals are provided for the data lines 30B connected to the sub-pixels 111 having the other colors in the first data cache stage T11, the data signals are provided for the data lines connected to the sub-pixels having the first color by controlling the data selection units connected to the data lines of the sub-pixels having the first color to be turned on in the second data cache stage T12.

The first data cache stage is earlier than the second data cache stage.

Figure 11:
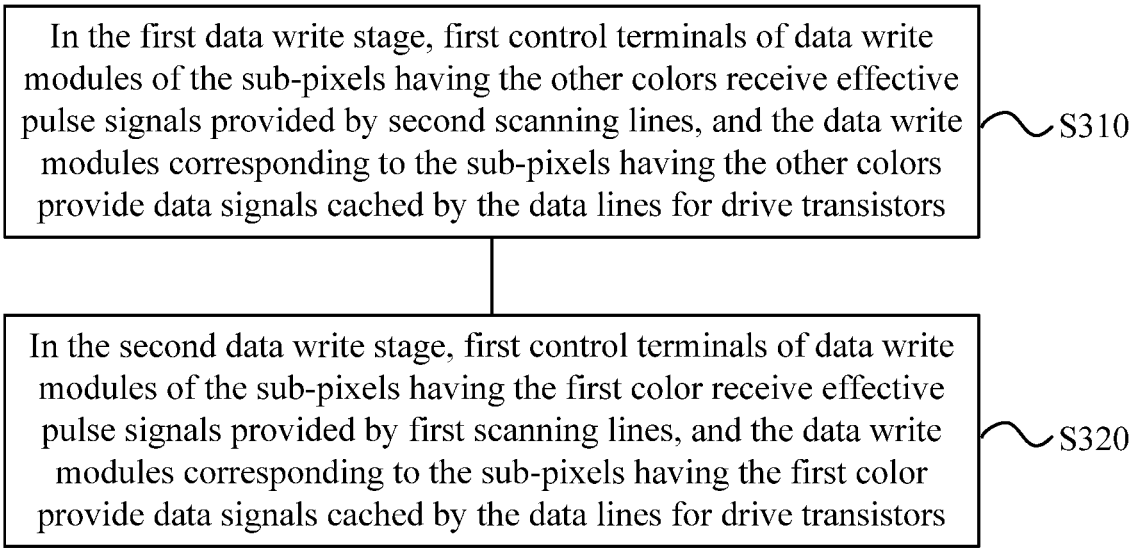
FIG. 11 is a flowchart of another driving method of a display panel according to an embodiment of the present disclosure.

On the basis of the preceding embodiments, FIG. 11 is a flowchart of another driving method of a display panel according to an embodiment of the present disclosure. In the same row of pixel units, within the time of one frame of the picture, start time of an effective pulse of the second scanning line is earlier than start time of an effective pulse of the first scanning line, and the data write stage includes a first data write stage and a second data write stage. As shown in FIG. 11, the driving method includes steps described below.

In S310, in the first data write stage, first control terminals of the data write modules of the sub-pixels having the other colors receive effective pulse signals provided by second scanning lines, and the data write modules corresponding to the sub-pixels having the other colors provide the data signals cached by the data lines for drive transistors.

Referring to FIG. 9 and FIG. 11, after the data signals are provided for the data lines 30B corresponding to the sub-pixels 111 having the other colors in the first data cache stage T11, the display panel controls the second scanning lines Scan2 to output control signals to the first control terminals P1B of the data write modules 21B corresponding to the sub-pixels 111 having the other colors to control the data write modules 21B corresponding to the sub-pixels 111 having the other colors to be turned on in the first data write stage T21, so the data write modules 21B in the pixel circuits 20B corresponding to the sub-pixels 111 having the other colors provide the data signals cached by the data lines 30B for the drive transistors T1B.

In S320, in the second data write stage, first control terminals of data write modules of the sub-pixels having the first color receive effective pulse signals provided by first scanning lines, and the data write modules corresponding to the sub-pixels having the first color provide data signals cached by the data lines for drive transistors.

Referring to FIG. 9 and FIG. 11, after the data signals are provided for the data lines 30A corresponding to the sub-pixels 110 having the first color in the second data cache stage T12, the display panel controls the first scanning lines Scan1 to output control signals to the first control terminals NA of the data write modules 21A corresponding to the sub-pixels 110 having the first color to control the data write modules 21A corresponding to the sub-pixels 110 having the first color to be turned on in the second data write stage T22, so the data write modules 21A in the pixel circuits 20A corresponding to the sub-pixels 110 having the first color provide the data signals cached by the data lines 30A for the drive transistors T1A.

The first data write stage is earlier than the second data write stage.

In the same row of pixel units, within the time of one frame of the picture, providing the effective pulse for the second scanning line may be simultaneous with providing the data signals for the data lines connected to the sub-pixels having the first color to perform caching.

Exemplarily, and still referring to FIG. 9, within the time T12, the control lines (e.g., CK3, CK6, CK9, and CK12) electrically connected to the control terminals of the data selection units 41 corresponding to the sub-pixels 110 having the first color are in an enabled state, at this time, the data selection units 41 corresponding to the sub-pixels 110 having the first color are in a turned-on state, and the data selection units provide the data signals for the data lines 30A connected to the sub-pixel 110 having the first color. Since providing the effective pulse for the second scanning lines Scan2 is simultaneous with providing the data signals for the data lines 30A connected to the sub-pixels 110 having the first color, so as to enable the second scanning lines Scan2 to output the control signals to the first control terminals P1B of the data write modules 21B corresponding to the sub-pixels 111 having the other colors to control the data write modules 21B corresponding to the sub-pixels 111 having the other colors to be turned on, so the data write modules 21B in the pixel circuits 20B corresponding to the sub-pixels 111 having the other colors provide the data signals cached by the data lines 30B for the drive transistors T1B.

In the same row of pixel units, within the time of one frame of the picture, end time of the effective pulse of the second scanning line may be the same as end time of the effective pulse of the first scanning line.

The end time of the effective pulse of the second scanning line Scan2 is configured to be the same as the end time of the effective pulse of the first scanning line Scan1, so that in the same row of pixel units, within the time of one frame of the picture, sub-pixels having different colors simultaneously complete the data writing.

Figure 12:
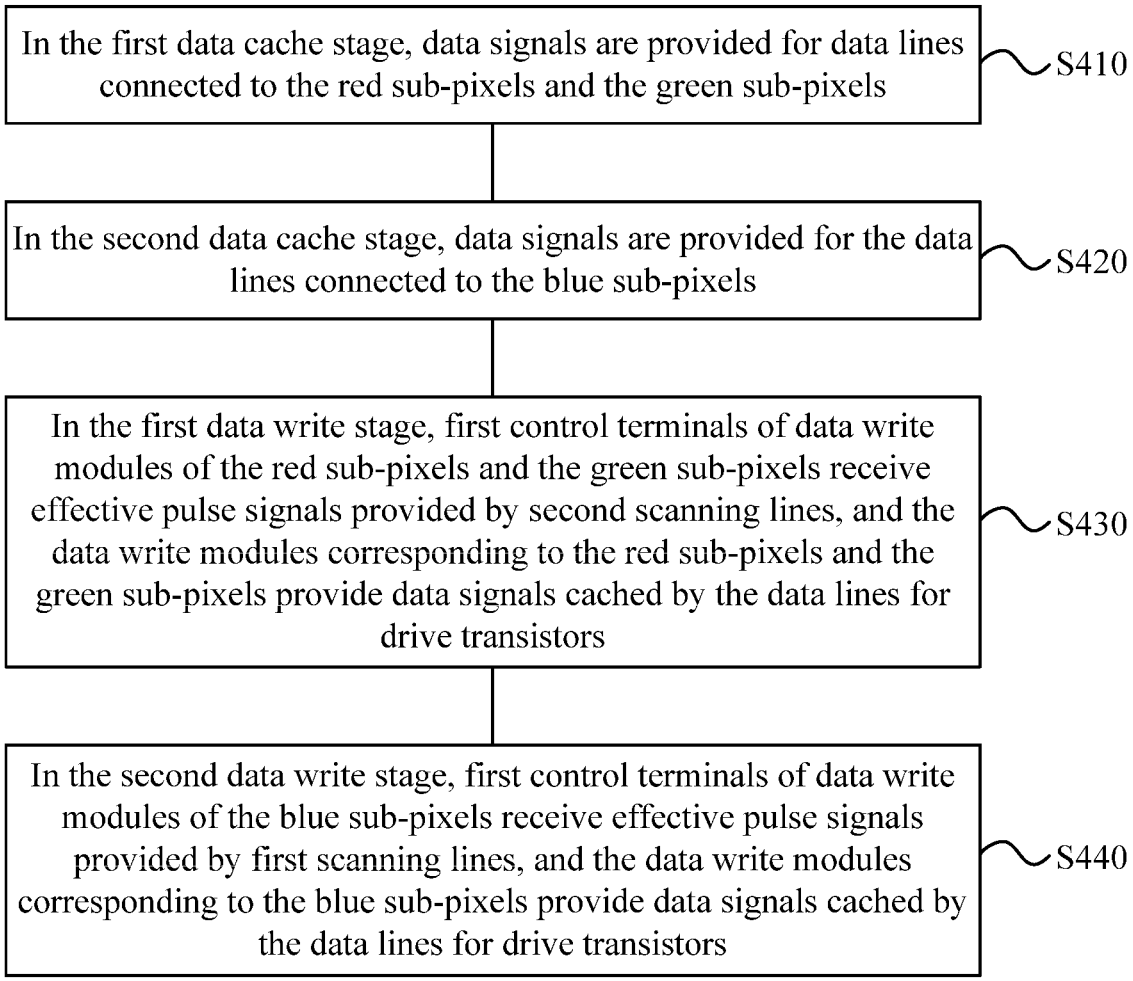
FIG. 12 is a flowchart of another driving method of a display panel according to an embodiment of the present disclosure.

On the basis of the preceding embodiments, FIG. 12 is a flowchart of another driving method of a display panel according to an embodiment of the present disclosure. The sub-pixels having the first color include blue sub-pixels, and the sub-pixels having the other colors include red sub-pixels R and green sub-pixels G. As shown in FIG. 12, the driving method includes steps described below.

When the pixel units in the display panel include the red sub-pixels R, the green sub-pixels G and the blue sub-pixels B, the sub-pixels having the first color include the blue sub-pixels, and the sub-pixels having the other colors include the red sub-pixels and the green sub-pixels.

In S410, in the first data cache stage, the data signals are provided for data lines connected to the red sub-pixels and the green sub-pixels.

In the first data cache stage T11, data selection units connected to the data lines of the red sub-pixels and the green sub-pixels are controlled to be turned on, and the data selection units provide the data signals for the data lines connected to the red sub-pixels and the green sub-pixels.

In S420, in the second data cache stage, the data signals are provided for data lines connected to the blue sub-pixels.

In the second data cache stage T12, data selection units connected to the data lines of the blue sub-pixels are controlled to be turned on, and the data selection units provide the data signals for the data lines connected to the blue sub-pixels.

In S430, in the first data write stage, first control terminals of data write modules of the red sub-pixels and the green sub-pixels receive effective pulse signals provided by second scanning lines, and the data write modules corresponding to the red sub-pixels and the green sub-pixels provide data signals cached by the data lines for drive transistors.

After providing the data signals for the data lines corresponding to the red sub-pixels and the green sub-pixels in the first data cache stage T11, the display panel controls the second scanning lines Scan2 to output control signals to the first control terminals of the data write modules corresponding to the red sub-pixels and the green sub-pixels to control the data write modules corresponding to the sub-pixels having the other colors to be turned on in the first data write stage T21, so the data write modules in the pixel circuits corresponding to the sub-pixels having the other colors provide the data signals cached by the data lines for the drive transistors.

In S440, in the second data write stage, first control terminals of data write modules of the blue sub-pixels receive effective pulse signals provided by first scanning lines, and the data write modules corresponding to the blue sub-pixels provide data signals cached by the data lines for drive transistors.

After providing the data signals for the data lines corresponding to the blue sub-pixels in the second data cache stage T12, the display panel controls the first scanning lines Scan1 to output control signals to the first control terminals of the data write modules corresponding to the blue sub-pixels to control the data write modules 21A corresponding to the blue sub-pixels 110 to be turned on in the second data write stage T22, so the data write modules in the pixel circuits corresponding to the blue sub-pixels provide the data signals cached by the data lines for the drive transistors.

It is to be noted that the preceding are only preferred embodiments of the present disclosure and the technical principles used therein. It is to be understood by those skilled in the art that the present disclosure is not limited to the embodiments described herein. Those skilled in the art can make various apparent modifications, adaptations, and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A display panel, comprising a display region and;

a non-display region, wherein the display region comprises pixel units arranged in an array, and each of the pixel units comprises sub-pixels having a plurality of colors;

wherein each of the sub-pixels comprises a pixel circuit and a light-emitting element, and the pixel circuit in each of the sub-pixels comprises a data write module, a light emission control module and a drive transistor; the non-display region comprises a multiplexer, and the multiplexer comprises a plurality of data selection units; each of the plurality of data selection units comprises one input terminal and a plurality of output terminals, and the plurality of output terminals of each of the plurality of data selection units are electrically connected to a plurality of data lines of the display region in one-to-one correspondence;

wherein in a same row of pixel units, first control terminals of data write modules of sub-pixels having a first color are connected to a same first scanning line; and in a same row of pixel units, first control terminals of data write modules of sub-pixels having other colors except the first color are connected to a same second scanning line;

wherein the data write module is configured to provide a data signal cached by a data line for the drive transistor; the light emission control module is connected in series respectively with the drive transistor and the light-emitting element, and the light emission control module is configured to control whether a drive current flows through the light-emitting element; and wherein in a same row of pixel units, within time of one frame of a picture, time of providing data signals for data lines connected to sub-pixels having the first color is within time of writing data signals cached by data lines into pixel circuits of sub-pixels having the other colors;

wherein the sub-pixels having the other colors at least comprise: sub-pixels having a second color and sub-pixels having a third color; wherein the first color, the second color and the third color are different;

wherein the display panel has at least one of the following characteristics:

wherein in a same row of pixel units, within the time of one frame of the picture, start time of an effective pulse of the second scanning line is earlier than start time of an effective pulse of the first scanning line; wherein within the time of one frame of the picture, the start time of the effective pulse of the second scanning line is t1, the start time of the effective pulse of the first scanning line is t2, each of the plurality of data selection units has a number n of output terminals connected to data lines of sub-pixels having the first color, and time of providing a data signal for a data line which corresponds to one of the sub-pixels having the first color and is connected to one of the output terminals of each of the plurality of data selection units is a1, wherein $t1-t2=a1 \cdot n$;

wherein in the same row of pixel units, within the time of one frame of the picture, start time of providing data signals for data lines connected to sub-pixels having the other colors is earlier than start time of providing data signals for data lines connected to sub-pixels having the first color; or wherein the data write module in the pixel circuit of each sub-pixel having the first color further comprises a second control terminal, the second control terminal is electrically connected to a second scanning line, and in a case where both the first scanning line and the second scanning line have effective pulses simultaneously, the data write module of each sub-pixel having the first color is turned on.

2. The display panel of claim 1, wherein in a same row of pixel units, within the time of one frame of the picture, providing data signals for data lines connected to sub-pixels having the first color is simultaneous with providing an effective pulse for a second scanning line.

3. The display panel of claim 1, wherein in a same row of pixel units, within the time of one frame of the picture, end time of an effective pulse of a second scanning line is the same as end time of an effective pulse of a first scanning line.

4. The display panel of claim 1, wherein the data write module of each sub-pixel having the first color comprises a first transistor;

wherein the data write module of each of sub-pixels having the other colors comprises a second transistor; and wherein a control terminal of the first transistor is electrically connected to a first scanning line, and a control terminal of the second transistor is electrically connected to a second scanning line.

5. The display panel of claim 1, wherein the data write module in the pixel circuit of each sub-pixel having the first color further comprises the second control terminal, the second control terminal is electrically connected to the second scanning line, and in a case where both the first scanning line and the second scanning line have effective pulses simultaneously, the data write module of each sub-pixel having the first color is turned on; wherein the data write module of each sub-pixel having the first color comprises a first transistor and a second transistor;

wherein the data write module of each of sub-pixels having the other colors comprises a second transistor; and wherein a control terminal of the first transistor is electrically connected to the first scanning line, and a control terminal of the second transistor is electrically connected to the second scanning line.

6. The display panel of claim 5, wherein the sub-pixels having the first color comprise blue sub-pixels, and sub-pixels having the other colors comprise red sub-pixels and green sub-pixels.

7. The display panel of claim 1, wherein the data write module in the pixel circuit of each sub-pixel having the first color further comprises the second control terminal, the second control terminal is electrically connected to the second scanning line, and in a case where both the first in line and the second scanning line have effective pulses simultaneously, the data write module of each sub-pixel having the first color is turn on; and wherein the drive transistor in each sub-pixel having the first color has a width-to-length ratio of a channel region smaller than a width-to-length ratio of a channel region of the drive transistor in each of sub-pixels having the other colors.

8. The display panel of claim 7, wherein the width-to-length ratio of the channel region of the drive transistor in each sub-pixel having the first color is A1, and the width-to-length ratio of the channel region of the drive transistor in each of sub-pixels having the other colors is A2, wherein $8 \leq A2 - A1 \leq 12$.

9. The display panel of claim 1, wherein the pixel circuit further comprises a threshold compensation module, a first reset module and a second reset module; and wherein the light emission control module comprises a third transistor and a fourth transistor, the threshold compensation module comprises a fifth transistor, the first reset module comprises a sixth transistor, and the second reset module comprises a seventh transistor.

10. The display panel of claim 9, wherein a first terminal of the third transistor is electrically connected to an input terminal of a first-level signal, a second terminal of the third transistor is electrically connected to a first terminal of the drive transistor, a first terminal of the fourth transistor is electrically connected to a second terminal of the drive transistor, and a second terminal of the fourth transistor is electrically connected to the light-emitting element;

wherein a first terminal of the fifth transistor is electrically connected to the second terminal of the drive transistor, and a second terminal of the fifth transistor is electrically connected to a control terminal of the drive transistor;

wherein a first terminal of the sixth transistor is electrically connected to a first reset signal terminal, and a second terminal of the sixth transistor is electrically connected to the control terminal of the drive transistor; and wherein a first terminal of the seventh transistor is electrically connected to a second reset signal terminal, and a second terminal of the seventh transistor is electrically connected to the light-emitting element.

11. The display panel of claim 10, wherein the plurality of output terminals of each of the plurality of data selection units have a number of n, wherein $n \geq 6$.

12. A display device, comprising:

a display panel, wherein the display panel comprises a display region and a non-display region, the display region comprises pixel units arranged in an array, and each of the pixel units comprises sub-pixels having a plurality of colors;

wherein each of the sub-pixels comprises a pixel circuit and a light-emitting element, and the pixel circuit in each of the sub-pixels comprises a data write module, a light emission control module and a drive transistor; the non-display region comprises a multiplexer, and the multiplexer comprises a plurality of data selection units; each of the plurality of data selection units comprises one input terminal and a plurality of output terminals, and the plurality of output terminals of each of the plurality of data selection units are electrically connected to a plurality of data lines of the display region in one-to-one correspondence;

wherein in a same row of pixel units, first control terminals of data write modules of sub-pixels having a first color are connected to a same first scanning line; and in a same row of pixel units, first control terminals of data write modules of sub-pixels having other colors except the first color are connected to a same second scanning line;

wherein the data write module is configured to provide a data signal cached by a data line for the drive transistor; the light emission control module is connected in series respectively with the drive transistor and the light-emitting element, and the light emission control module is configured to control whether a drive current flows through the light-emitting element; and wherein in a same row of pixel units, within time of one frame of a picture, time of providing data signals for data lines connected to sub-pixels having the first color is within time of writing data signals cached by data lines into pixel circuits of sub-pixels having the other colors;

wherein the sub-pixels having the other colors at least comprise: sub-pixels having a second color and sub-pixels having a third color; wherein the first color, the second color and the third color are different;

wherein the display panel has at least one of the following characteristics;

wherein in a same row of pixel units, within the time of one frame of the picture, start time of an effective pulse of the second scanning line is earlier than start time of an effective pulse of the first scanning line; wherein within the time of one frame of the picture, the start time of the effective pulse of the second scanning line is t1, the start time of the effective pulse of the first scanning line is t2, each of the plurality of data selectin units has a number n of output terminals connected to data lines of sub-pixels having the first color, and time of providing a data signal for a data line which corresponds to one of the sub-pixels having the first color and is connected to one of the output terminals of each of the plurality of data selection units is a1, wherein $t1-t2=a1 \cdot n$;

wherein in the same row of pixel units, within the time of one frame of the picture, start time of providing data signals for data lines connected to sub-pixels having the other colors is earlier than start time of providing data signals for data lines connected to sub-pixels having the first color; or wherein the data write module in the pixel circuit of each sub-pixel having the first color further comprises a second control terminal, the second control terminal is electrically connected to a second scanning line, and in a case where both the first scanning line and the second scanning line have effective pulses simultaneously, the data write module of each sub-pixel having the first color is turned on.

13. A driving method of a display panel, wherein the display panel comprises a display region and a non-display region, the display region comprises pixel units arranged in an array, and each of the pixel units comprises sub-pixels having a plurality of colors;

wherein each of the sub-pixels comprises a pixel circuit and a light-emitting element, and the pixel circuit in each of the sub-pixels comprises a data write module, a light emission control module and a drive transistor; the non-display region comprises a multiplexer, and the multiplexer comprises a plurality of data selection units; each of the plurality of data selection units comprises one input terminal and a plurality of output terminals, and the plurality of output terminals of each of the plurality of data selection units are electrically connected to a plurality of data lines of the display region in one-to-one correspondence;

wherein in a same row of pixel units, first control terminals of data write modules of sub-pixels having a first color are connected to a same first scanning line; and in a same row of pixel units, first control terminals of data write modules of sub-pixels having other colors except the first color are connected to a same second scanning line;

wherein the data write module is configured to provide a data signal cached by a data line for the drive transistor; the light emission control module is connected in series respectively with the drive transistor and the light-emitting element, and the light emission control module is configured to control whether a drive current flows through the light-emitting element; and wherein in a same row of pixel units, within time of one frame of a picture, time of providing data signals for data lines connected to sub-pixels having the first color is within time of writing data signals cached by data lines into pixel circuits of sub-pixels having the other colors, wherein a drive cycle of the display panel comprising a data cache stage, a data write stage and a light emission stage; the driving method comprising:

in the data cache stage, transmitting, by the multiplexer, the data signals to the plurality of data lines to perform caching;

in the data write stage, providing, by data write modules, the data signals cached by the plurality of data lines for drive transistors; and in the light emission stage, controlling, by the light emission control module, the drive current to flow through the light-emitting element;

wherein the sub-pixels having the other colors at least comprise: sub-pixels having a second color and sub-pixels having a third color; wherein the first color, the second color and the third color are different;

wherein the driving method has at least one of the following characteristics:

wherein in a same row of pixel units, within the time of one fame of the picture, start time of providing data signals for data lines connected to sub-pixels having the other colors is earlier than start time of providing data signals for data lines connected to sub-pixels having the first color, and the data cache stage comprises a first data cache stage and a second data cache stage; the driving method comprises: in the first data cache stage, providing data signals for data lines connected to sub-pixels having other colors; and in the second data cache stage, providing data signals for data lines connected to sub-pixels having the first color; wherein the first data cache stage is earlier than the second data cache stage; or wherein in the same row of pixel units, within the time of one frame of the picture start time of an effective pulse of second scanning line is earlier than start time of an effective pulse of a first scanning line, and the data write stage comprises a first data write stage and a second data write stage; the driving method comprises: in the first data write stage, receiving by first control terminals of data write modules of sub-pixels having the other colors, effective pulse signals provided by second scanning lines, and providing, by the data write modules corresponding to the sub-pixels having the other colors, data signals cached by data lines for drive transistors; and in the second data write stage, receiving, by first control terminals of data write modules of sub-pixels having the first color, effective pulse signals provided by first scanning lines, and providing, by the data write modules corresponding to the sub-pixels having the first color, data signals cached by data lines for drive transistors; wherein the first data write stage is earlier than the second data write stage; or wherein in the same row of pixel units, within the time of one frame of the picture, start time of providing data signals for data lines connected to sub-pixels having the other colors is earlier than start time of providing data signals for data lines connected to sub-pixels having the first color, and the data cache stage comprises the first data cache stage and the second data cache stage; the driving method comprises: in the first data cache stage, providing data signals for data lines connected to sub-pixels having other colors; and in the second data cache stage, providing data signals for data lines connected to sub-pixels having the first color; wherein the first data cache stage is earlier than the second data cache stage; and wherein the sub-pixels having the first color comprise blue sub pixels, and the sub-pixels having the other colors comprise red sub-pixels and green sub-pixels; wherein the driving method comprises: in the first data cache stage, providing data signals for data lines connected to the red sub-pixels and the green sub-pixels; in the second data cache stage, providing data signals for data lines connected to the blue sub-pixels; in the first data write stage, receiving, by first control terminals of data write modules of the red sub-pixels and the green sub-pixels, effective pulse signals provided by second scanning lines, and providing, by the data write modules corresponding to the red sub-pixels and the green sub-pixels, data signals cached by data lines for drive transistors; and in the second data write stage, receiving, by first control terminals of data write modules of the blue sub-pixels, effective pulse signals provided by first scanning lines, and providing, by the data write modules corresponding to the blue sub-pixels, data signals cached by data lines for drive transistors.

14. The driving method of claim 13, wherein in a same row of pixel units, within the time of one frame of the picture, providing an effective pulse for a second scanning line is simultaneous with providing data signals for data lines connected to sub-pixels having the first color to perform caching.

15. The driving method of claim 13, wherein in a same row of pixel units, within the time of one frame of the picture, end time of an effective pulse of a second scanning line is the same as end time of an effective pulse of a first scanning line.

* * * * *